US006644258B1

(12) United States Patent
Smith

(10) Patent No.: US 6,644,258 B1
(45) Date of Patent: Nov. 11, 2003

(54) VCT MECHANISM HAVING A LOCK PIN ADAPTED TO RELEASE AT A PRESSURE HIGHER THAN THE PRESSURE REQUIRED TO HOLD THE LOCK PIN IN THE RELEASED POSITION

(75) Inventor: Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/403,859

(22) Filed: Mar. 31, 2003

Related U.S. Application Data

(60) Provisional application No. 60/374,332, filed on Apr. 22, 2002.

(51) Int. Cl.[7] ..... F01L 1/34

(52) U.S. Cl. ..... 123/90.17; 123/90.15; 123/90.27; 123/90.31; 464/160

(58) Field of Search ..... 123/90.15, 90.17, 123/90.27, 90.31; 251/12, 14; 464/1, 2, 160

(56) References Cited

U.S. PATENT DOCUMENTS

| | | | | |
|---|---|---|---|---|
| 5,979,380 A | | 11/1999 | Nakadouzono et al. | 123/90.17 |
| 6,006,708 A | | 12/1999 | Ken et al. | 123/90.17 |
| 6,006,709 A | | 12/1999 | Ushida | 123/90.17 |
| 6,035,819 A | | 3/2000 | Nakayoshi et al. | 123/90.17 |
| 6,105,543 A | * | 8/2000 | Ogawa | 123/90.17 |
| 6,250,265 B1 | * | 6/2001 | Simpson | 123/90.17 |
| 6,378,476 B2 | * | 4/2002 | Okada et al. | 123/90.17 |
| 6,497,208 B2 | * | 12/2002 | Miyasaka | 123/90.17 |
| 2001/0544406 | | 12/2001 | Okada et al. | |

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

A variable camshaft timing phaser for an internal combustion engine that varies rotation phase including a housing, a rotor, a locking pin, and a piston. The locking pin is moveable in a first direction, which urges a tapered end of the locking pin to engage a tapered recess in the rotor, and a second direction, opposite the first direction, to disengage the rotor. The is driven by an engine output in synchronism with the engine revolutions, the rotor is connected to the camshaft and has a fluid passage connecting a source of engine oil to the tapered recess in the rotor. The piston is located within the fluid passage and has a piston surface contacting the locking pin. The piston has a cross-section that is less than the cross-section of the locking pin, and blocks the fluid passage when the locking pin is locked, moving to a position which allows fluid to pass by the piston in the recess and press on the locking pin, so that higher pressure is required to unlock the locking pin than to hold it in its unlocked position.

6 Claims, 1 Drawing Sheet

VCT MECHANISM HAVING A LOCK PIN ADAPTED TO RELEASE AT A PRESSURE HIGHER THAN THE PRESSURE REQUIRED TO HOLD THE LOCK PIN IN THE RELEASED POSITION

REFERENCE TO RELATED APPLICATIONS

This application claims an invention which was disclosed in Provisional Application No 60/374,332, filed Apr. 22, 2002, entitled "VCT Locking Pin Release Mechanism". The benefit under 35 USC §119(e) of the United States provisional application is hereby claimed, and the aforementioned application is hereby incorporated herein by reference.

BACKGROUND OF THE INVENTION

1. Field of the Invention

The invention is related to a hydraulic control system for controlling the operation of a variable camshaft timing (VCT) system. More specifically, the present invention relates to a control system for vane-type or similar cam phasers utilizing oil pressure to vary the crankshaft-to-camshaft phasing.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor with one or more vanes, mounted to the end of the camshaft, surrounded by a housing with the vane chambers into which the vanes fit. It is possible to have the vanes mounted to the rotor, and the chambers in the housing, as well. The housing's outer circumference forms the sprocket, pulley or gear accepting drive force through a chain, belt or gears, usually from the camshaft, or possibly from another camshaft in a multiple-cam engine.

The phaser operates using engine oil as the working fluid, introduced into the oil chambers on either side of vanes, so as to rotate the camshaft angularly relative to the drive from the crankshaft.

Since the phasers cannot be perfectly sealed they are subject to oil loss through leakage. During normal engine operation, the oil pressure and flow generated by the engine oil pump is generally sufficient to keep the phaser full of oil and fully functional. However, when the engine is shut down, the oil can leak from the VCT mechanism, leaving the chambers filled with air that must be purged. During engine start conditions, before the engine oil pump generates oil pressure, the lack of controlling oil pressure and air in the chambers can allow the phaser to oscillate excessively due to lack of oil, producing noise and possibly damaging the mechanism. Additionally, it is desirable to have the phaser locked in a particular position while the engine is attempting to start.

One solution employed in prior art phasers is to introduce a locking pin that will lock the phaser in a specific phase angle position relative to the crankshaft when insufficient oil exists in the chambers. These locking pins are typically spring loaded to engage and are released using engine oil pressure. Therefore, when the engine is shut down and engine oil pressure reaches some predetermined low value the spring-loaded pin will engage and lock the phaser. During engine start, the pin remains engaged until the engine oil pump generates enough pressure to release the pin.

A drawback of these current locking pins is that they must be held in the released position using the lowest engine oil pressure available, to avoid locking the VCT mechanism while the engine is running. Some engines, when operating at high oil temperatures or running at low RPM, such as at idle, can only generate a low oil pressure. In addition, engines that are worn out generate an even lower oil pressure at hot idle conditions. In some engines this may be as low as 5 PSI. If the phaser lock pin is designed to release at this low oil pressure, when a cold engine first starts the locking pin may release before all of the air is sufficiently purged from the phaser. This would allow the phaser to move before it is full of oil and fully operational. Under such conditions, the phaser could oscillate.

Therefore, a locking pin is needed that releases at a higher pressure to allow the phaser to purge a sufficient amount of air during engine start-up, while still allowing the locking pin to remain released at the lower pressures available when the engine is warmed and idling.

SUMMARY OF THE INVENTION

The present invention solves the problem of not sufficiently purging the correct quantity of air from the VCT. The insufficient purging of air is the most problematic at idle, when the engine is operating at high oil temperatures and running at a low RPM. This especially is a problem in older cars, where the engines are worn out and generate an even lower oil pressure at hot idle conditions.

The present invention comprises a mechanism that causes the locking pin to release at a higher pressure than is required to hold the locking pin in the released position. The higher pressure required for release allows the phaser to purge more air before releasing the phaser to its functions. The lower pressure required to hold the locking pin allows the VCT to operate at low oil pressure conditions, such as hot idle without the locking pin engaging or partially engaging the rotor.

The invention is a locking vane phaser for a variable camshaft timing system in an internal combustion engine, in which the locking pin requires a higher oil pressure to retract on initial start-up, but remains unlocked at the lower pressures present during high temperature and/or idle operation. The locking pin is pushed back by a ball or cylinder shaped piston in the oil passage leading to the recess in which the locking pin fits. The piston has a cross-sectional area that is smaller than the locking pin cross-sectional area. When the piston is pushed into the tapered recess, the oil can pass the piston and push against the larger area of the locking pin, so that a lower pressure is needed to hold the pin back than was required to move the piston.

DETAILED DESCRIPTION OF THE INVENTION

Figure 1:
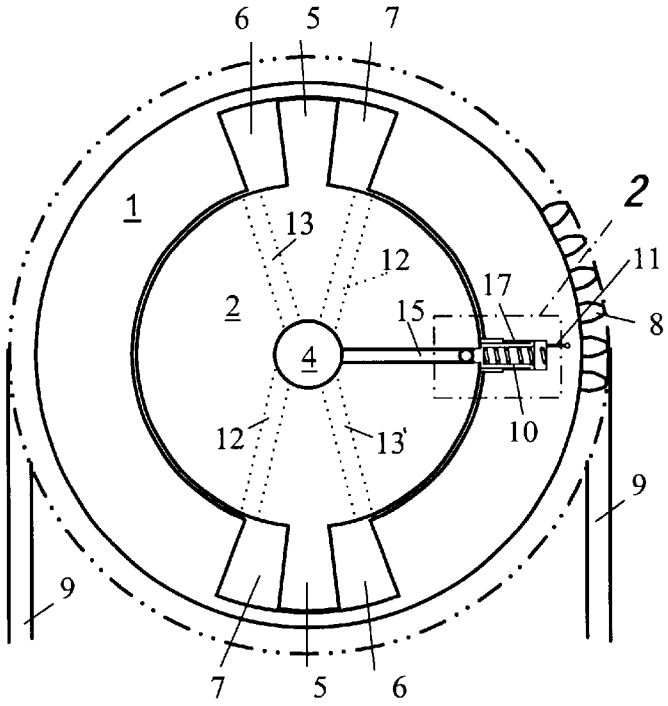
FIG. 1 shows a front view of a VCT phaser incorporating the invention.

Referring to FIG. 1, a vane-type VCT phaser comprises a housing (1), the outside of which has sprocket teeth (8) which mesh with and are driven by timing chain (9). Inside the housing (1) are fluid chambers (6) and (7). Coaxially within the housing (1), free to rotate relative to the housing, is a rotor (2) with vanes (5) which fit between the chambers (6) and (7), and a central control valve (4) which routes pressurized oil via passages (12) and (13) to chambers (6) and (7), respectively. Pressurized oil introduced by valve (4) into passages (12) will push vanes (5) counterclockwise relative to the housing (1), forcing oil out of chambers (6) into passages (13) and into valve (4). It will be recognized by one skilled in the art that this description is common to vane phasers in general, and the specific arrangement of vanes, chambers, passages and valves shown in FIG. 1 may be varied within the teachings of the invention. For example, the number of vanes and their location can be changed—some phasers have only a single vane, others as many as a dozen, and the vanes might be located on the housing and reciprocate within chambers on the rotor. The housing might be driven by a chain or belt or gears, and the sprocket teeth might be gear teeth or a toothed pulley for a belt.

Figure 2A:
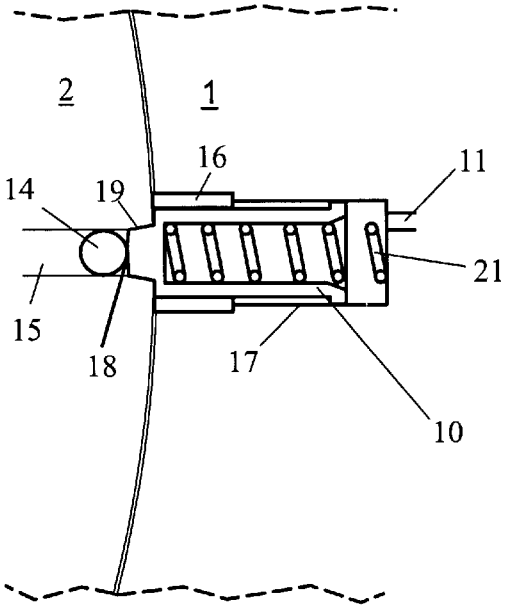
FIG. 2*a* & 2*b* show engaged and disengaged positions of the present invention respectively, in a detail from within box 2 in FIG. 1.

Referring to FIG. 1 and the detail of FIG. 2*a*, in the phaser of the invention, a locking pin (10) slides in a bore (17) in the housing (1), and is pressed by a spring (21) into a recess (19) in the rotor (2) to lock the rotor (2) and housing (1) into a fixed rotational position. Vent (11) allows any oil which might leak past the pin (10) to be discharged. A bushing (16) may be provided in the bore, surrounding at least the inner end (20) of the locking pin, to provide a better seal.

A fluid passage (15) feeds pressurized oil from the engine oil supply (not shown) into the recess (19). A ball-shaped or cylindrical piston (14) is located within the fluid passage (15) and contacts the inner tip (18) of locking pin (10). The piston (14) is sized so as to fit in and fully block passage (15) when the locking pin (10) is engaged, as shown in FIG. 2*a*.

The diameter (and hence surface area) of the bore (17), and of the inner end (20) of the locking pin body which fits in the bore (17), is larger than the diameter of the passageway (15). Thus, the piston (14), which fits in the passage (15), also has a smaller surface area than the locking pin body. The surface area of the piston (14) is chosen such that at engine start-up, the piston cannot push the locking pin (10) back against the force of the spring (21) until the supply oil pressure has risen to a level which is sufficient that oil in passages (12) or (13) can fully fill chambers (6) and (7) and purge any air which might have been introduced due to leakage while the engine was shut down.

Figure 2B:
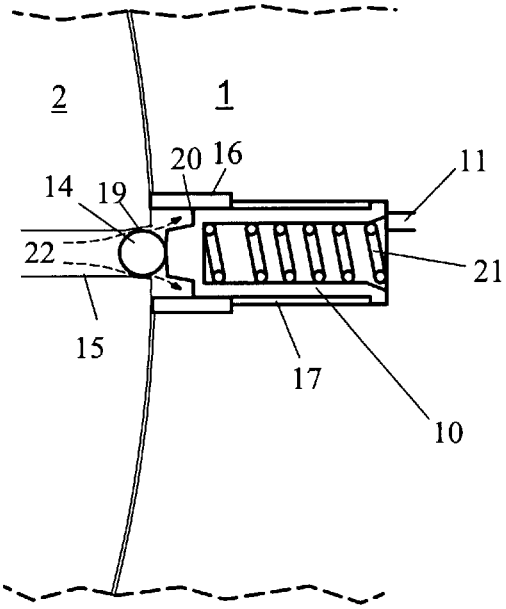

When the pressure has risen to the selected pressure (or higher), the piston (14) begins to push the locking pin (10) back from the recess (19), as shown in FIG. 2*b*. When the piston (10) is pushed into the tapered recess (19), the oil can flow (22) past the piston (10) and push against the larger area (20) of the locking pin (10). This larger area allows a lower pressure to hold the pin back than was required to move the piston away from the recess in the first instance, and the area is chosen so that low oil pressure as the engine heats up and is reduced to idle will still suffice to keep the locking pin (10) in its bore (17). Being round (ball-shaped or cylindrical), the piston (14) does not interfere with the rotation of the rotor (2) relative to the housing (1) as they shift and move the passage (15) out of alignment with the pin (10).

When the engine is shut down, the pressure in passage (15) drops below the chosen pressure which will hold the pin (10) in the bore (17) against the force of the spring (21), and the locking pin (10) moves toward the rotor (2). When the pin (10) and recess (19) come into alignment, the pin (10) drops into the recess (19), and locks the rotor (2) and housing (1) once more.

The movement and placement of the locking pin of the present invention is not limited to the orientation or direction stated in the application. For example, the locking pin may be axially oriented and slide outward towards the housing when the engine oil pressure drops below the chosen pressure that will holed the pin the bore against the force of the spring.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable camshaft timing phaser for an internal combustion engine having at least one camshaft, comprising:

a housing having an outer circumference for accepting drive force;

a rotor for connection to a camshaft, coaxially located within the housing, capable of rotation to shift the relative angular position of the housing and rotor, having a tapered recess in an outer circumference and a fluid passage coupling the tapered recess to a source of engine fluid pressure;

a locking pin slideably located in a bore, comprising a body having a diameter adapted to a fluid-tight fit in the bore, and an inner end with a tapered portion adapted to fit in the tapered recess, the locking pin being moveable in the bore from a locked position in which the tapered end fits into the tapered recess, locking the relative angular position of the housing and the rotor, to an unlocked position in which the housing and the rotor are free to move;

a spring located in the bore opposite the inner end of the locking pin, urging the locking pin inward toward the locked position; and a piston located within the fluid passage with a fluid tight fit, the piston being movable from a first position inside the fluid passage and blocking fluid flow therein, to a second position at least partially in the tapered recess and allowing fluid to flow past the piston and into the tapered recess; the piston being in the first position when the locking pin is in the locked position with the tapered end in the tapered recess, so that when the locking pin is in the locked position and fluid pressure is introduced into the fluid passage, the piston presses against the tapered end of the locking pin against the force of the spring, and when the pressure reaches a release level, the piston overcomes the force of the spring and moves the locking pin outwards toward the unlocked position, and when the piston reaches the second position fluid flows past the piston and applies pressure against the inner end of the locking pin, so that a holding level of pressure holds the locking pin in the unlocked position;

the piston having a cross-sectional area which is less than a cross-sectional area of the diameter of the body of the locking pin, so that the release level of pressure is greater than the holding level of pressure.

2. The variable camshaft timing phaser of claim 1, further comprising a bushing in the bore surrounding at least the inner end of the locking pin.

3. The variable camshaft timing phaser of claim 1, wherein the piston is spherical.

4. The variable camshaft timing phaser of claim 1, wherein the piston is cylindrical.

5. The variable camshaft timing phaser of claim 1, wherein the bore is radial in orientation.

6. The variable camshaft timing phaser of claim 1, wherein the bore is axial in orientation.

* * * * *